US005649523A

United States Patent [19]

Scott

[11] Patent Number: 5,649,523

[45] Date of Patent: Jul. 22, 1997

[54] BALL THROWING APPARATUS

[76] Inventor: Jack C. Scott, 8547 Amestoy Ave., Northridge, Calif. 91325

[21] Appl. No.: 427,283

[22] Filed: Apr. 21, 1995

[51] Int. Cl.[6] ..... F41R 4/00

[52] U.S. Cl. ..... 124/78

[58] Field of Search ..... 124/6, 78, 48, 124/51.1

[56] References Cited

U.S. PATENT DOCUMENTS

| | | | |
|---|---|---|---|
| 2,716,973 | 9/1955 | Desi | 124/78 |
| 2,737,941 | 3/1956 | Carrau | 124/78 |
| 3,538,900 | 11/1970 | Samuels | 124/78 |
| 3,734,075 | 5/1973 | Staples | 124/1 |
| 3,785,358 | 1/1974 | D'Angelo et al. | 124/78 |
| 3,794,011 | 2/1974 | Newgarden | 124/1 |
| 4,026,646 | 5/1977 | Sweeton | 124/48 X |
| 4,352,348 | 10/1982 | Griffith | 124/78 |
| 4,442,823 | 4/1984 | Floyd et al. | 124/78 |
| 4,632,088 | 12/1986 | Bruce | 124/78 |
| 4,712,534 | 12/1987 | Nozato | 124/78 |
| 4,834,060 | 5/1989 | Greene | 124/78 |
| 5,046,476 | 9/1991 | Nozato | 124/78 |
| 5,107,820 | 4/1992 | Salansky | 124/78 |

*Primary Examiner*—John A. Ricci
*Attorney, Agent, or Firm*—Robert E. Kleve

[57] ABSTRACT

The invention comprises a ball throwing device having a main frame, a wheel support frame within said main frame, said wheel support frame having at least three projecting and spin imparting wheels rotatably mounted to said wheel frame at even intervals about a common axis. A motor is mounted adjacent each wheel and connected to their respective wheel for driving said wheels at selective rates of speed for each wheel. The wheels are adapted to receive the balls along a common axis between them and engage and project the ball forward along the common axis with the speed of each wheel being selectively determined to impart a selective spin to the ball at the engagement points of the three wheels with the ball-about the common axis, with the three wheels lying in the same plane perpendicular to the common axis to engage the ball simultaneously with one another for the projection and imparting of the spin to the ball.

4 Claims, 3 Drawing Sheets

BALL THROWING APPARATUS

This invention relates to ball projecting or throwing and to spin imparting devices.

It is an object of the invention to provide a novel ball throwing device, which has at least three individually powered drive wheels at individually selective speed positioned in common about a plane transverse to a common axis and with the wheels acting to engage portions of the ball at intervals about the circumference of the ball along the plane of less than 180 degrees, and with each of the at least three wheels being powered at selectively varying speeds to provide selectively varying spins to the ball as the wheels engage the ball to propell the bail initially along the common axis.

It is another object of the invention to provide a novel ball projecting device which provides a spin upon a ball as it is being projected forward by simultaneously engaging the ball in at least three different location about the circumference of the ball along a plane at least generally transverse to the path of projected ball.

It is another object of the invention to provide a novel ball projecting device having at least three drive wheels lying transverse to the initial path of projecting the ball forward by the forward rotation of the wheels, with the wheels varying in speed at different locations to provide varying spin to the ball.

Further objects and advantages of the invention will become apparent as the description proceeds and when taken in conjunction with the accompanying drawings wherein:

BRIEF DESCRIPTION OF PREFERRED EMBODIMENT

Briefly stated, the invention comprises a ball throwing and spinning device having three individually power driven wheels mounted in a common plane at 120 degree intervals about a common axis. Each of the drive wheels are adapted to engage a portion of the ball at intervals about the circumference of the ball simultaneously and rotate in the same direction to project the ball forward and are powered at individual selective speeds to impart selective spins to the ball. The three drive wheels are mounted on a wheel frame to pivot about a horizontal axis on the main frame to change the elevation of the wheels and thereby change the elevation of the projection of the ball and the wheel frame is pivotally mounted on an axis perpendicular to the horizontal axis to pivot the wheels to either side to change the projection of the ball to either side.

Figure 1:
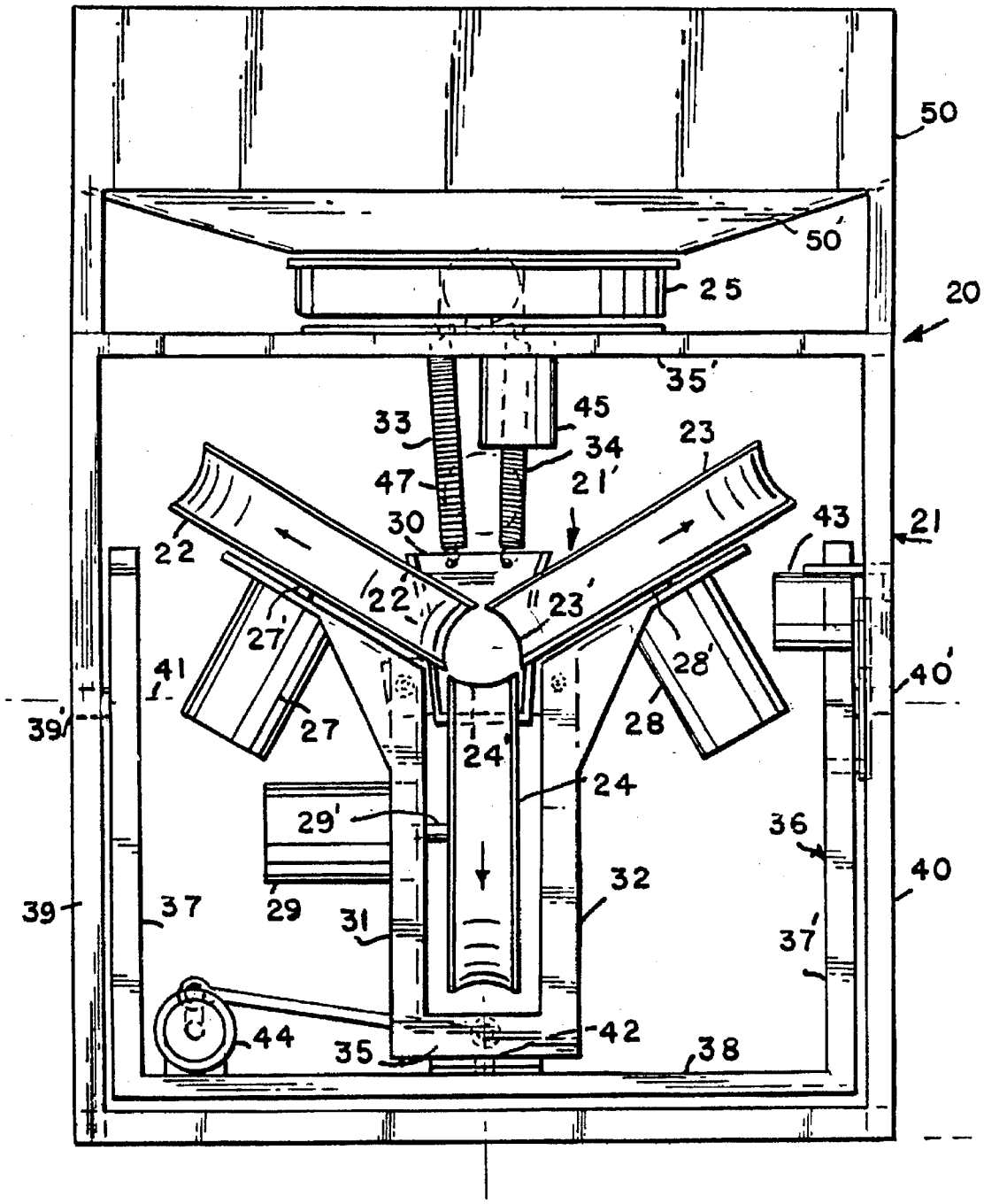
FIG. 1 is a front elevational view of the three drive wheel ball throwing and spin imparting device.
Figure 2:
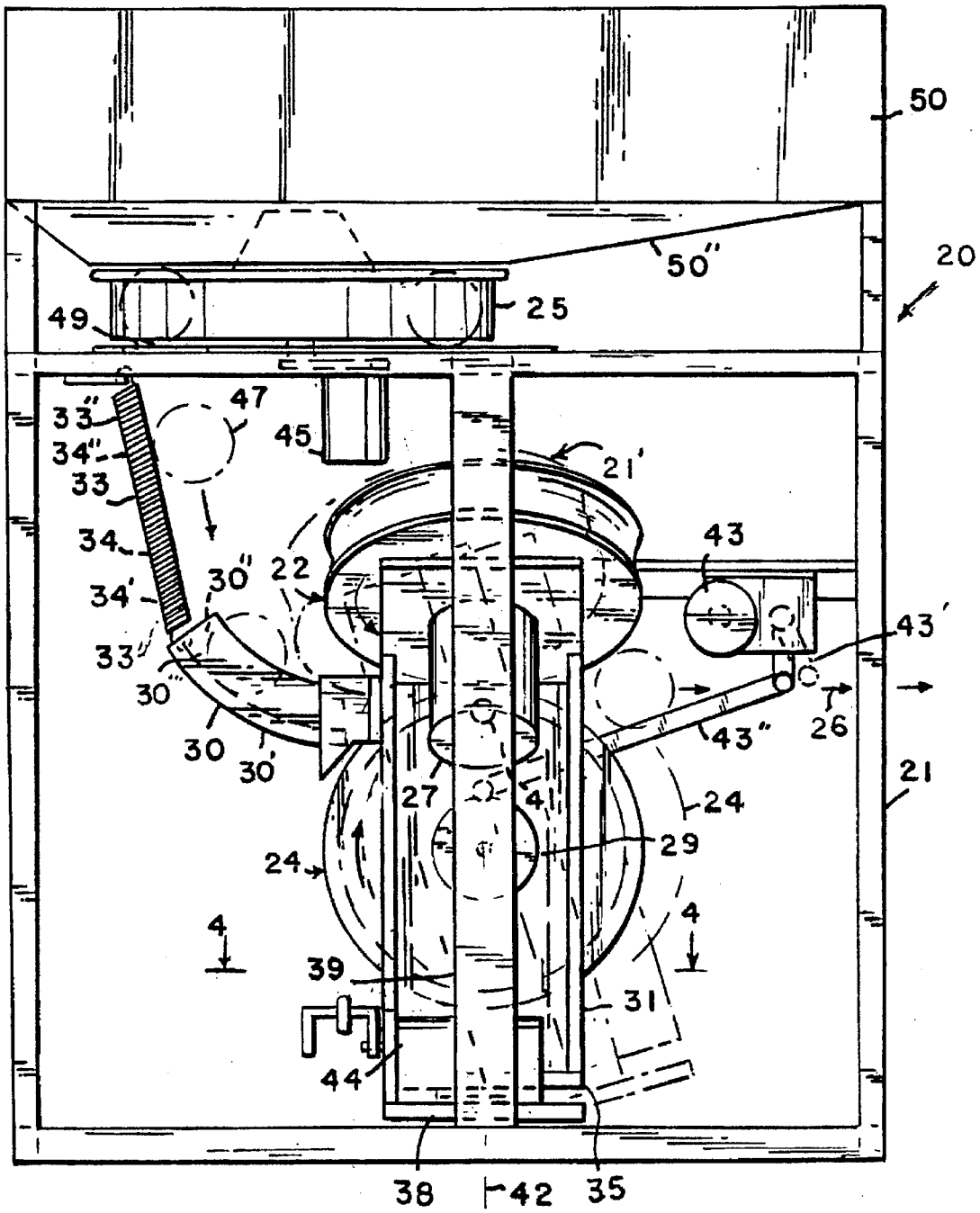
FIG. 2 is a side elevational view of the three drive wheel ball throwing and spin imparting device.
Figure 3:
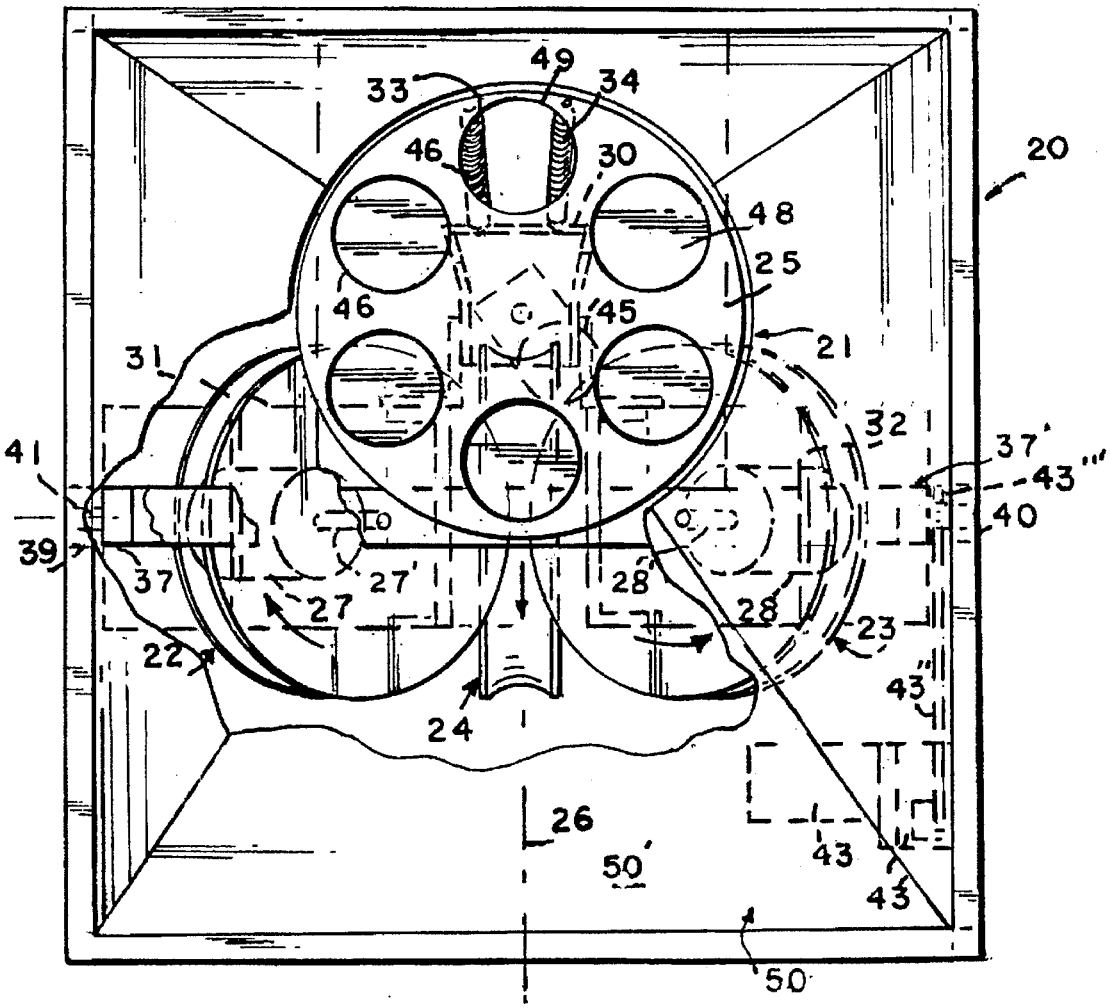
FIG. 3 is a top plan view of the three wheel ball projecting and spining device.
Figure 4:
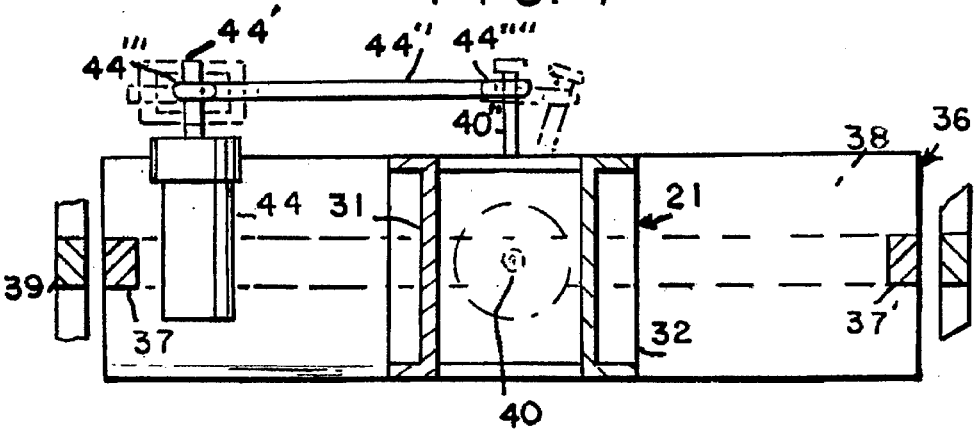
FIG. 4 is a cross sectional view taken along line 4—4 of FIG. 2.

Referring more particularly to the drawings, in FIGS. 1, 2, and 3, the ball projecting and spin device 20 is illustrated having a main frame 21 with a wheel support frame 21' therein. Three power driven ball projecting and spin imparting wheels 22,23, and 24 are rotatably mounted on the support frame 21' at 120 degree intervals about a common axis 26 with the three wheels in a common plane perpendicular to the common axis. The three wheels 22,23, and 24 are power driven by three motors 27,28, and 29 respectively. The three motors are also mounted on the wheel support frame with their shafts 27',28' and 29' fixed to the wheels 22,23 and 24 respectively and powering the motors rotates the shafts to rotate the wheels. An arcuate baseball guideway 30 is attached to the side plates 31 and 32 of the support frame 22 at the rear of the wheels. The arcuate guideway has a curved bottom plate portion 30' with side flanges 30" and 30"' diverging away from the bottom portion 30' on each side of the bottom wheel 24. The side flanges 30" and 30"' are fixed to the bottom plate portion 30'.

Two coil springs 33 and 34 provide a second guideway part from a rotary feed member 25 to the arcuate guideway 30. The coil springs 33 and 34 have their bottom ends 33' and 34' attached to the arcuate guideway 30 at the top of the bottom plate and have their top ends 33" and 34" attached to the top portion 35' of the main frame behind the ball drop opening 49. The coil springs 33 and 34 are mounted in spaced relation to one another and diverge outward and upward at a shallow angle relative to one another.

The wheel support frame 21' has two side flanges 31 and 32 fixed together in spaced, vertical relation at their lower ends by a bottom flange portion 35. A U shaped pivoting frame 36 has a pair of vertical side legs 37 and 37' fixed together at their bottom in spaced relation by a bottom flange 38. The U shaped pivoting frame 36 is pivotally mounted to the two vertical side rods 39 and 40 of the main frame 21 at pivotal connections 39' and 40' to its side legs 37 and 37' so that the U frame 36 pivots about the horizontal axis of 41 on its side legs 37 and 37'.

The bottom flange 35 of the wheel support frame 21' is pivotally mounted to the bottom flange 38 of the U shaped frame about the axis 42, which is perpendicular to the horizontal axis of the U shaped frame so that the wheel support frame can pivot about the horizontal axis 41 by pivoting with the U shaped frame 36 and or it can pivot about the axis 42 in perpendicular relation to the axis 41.

Thus, the three wheels 22,23 and 24 can be pivoted on the wheel frame 21' from left to right or visa versa on the axis 42 on the pivot connection between the support frame 21' and the U shaped frame 36 for a change in the horizontal or azmith direction of the three wheels 22, 23, and 24; and/or the U shaped frame 36 can be pirated to an upward downward direction pivoting on the horizontal axis connection with the main frame to pivot the wheel support frame 21' and the three wheels 22,23, and 24 thereon to an upward or downward angle to change the elevation of the three wheels 22,23, and 24.

A D.C. servo motor 43 drives a redaction gear whose output shaft rotates an arm 43'. The arm 43' is pivotally connected to a lever 43" at one end and the lever is pivotally connected to the U shaped frame 36 at its other end 43"'. The three motors 27, 28, and 29 are also conventional D.C. motors.

By powering the D.C. motor 43 in one direction, the arm 43' rotates counterclockwise, when viewed from FIG. 2, about pivot point 41 which draws the lever arm 43' from left to right which pivots the U shaped frame counterclockwise about pivot point 41 on pivots 39 and 40, which pivots the wheel support frame mounted thereon and the drive wheels mounted on the support frame forward and upward, thereby elevating the wheels so that the wheels will project the ball initially upward at a higher angle, such as shown in phantom lines in FIG. 2. Conversely, powering the D.C. motor 43 in the other direction, rotates the arm 43' clockwise, pushing the lever arm 43" from right to left, thereby pivoting the U shaped frame 36 rearward and its forward end downward, thereby lowering the projection path of the ball along the common axis 26 by the driving of the wheels 22,23, and 24. A second D.C. motor 44 powers the rotation of the wheel support frame and the wheels mounted thereon about the axis 42 on its pivotal mounting to the bottom of the U shaped frame. The motor 44 is mounted on the U shaped frame 36 and powering it rotates the crank 44', moves the lever arm 44" either left to right or visa versa, and its pivotal connection, at one end 44''' to the crank and its pivotal connection 44'''' at the other end to the rod 40" fixed to the wheel support frame pivots the wheel support frame in either direction about the axis 42, depending upon the direction of rotation of the motor. A third D.C. servo motor 45 powers the rotation of the rotary feed member 25 about its rotational axis 45'.

The rotary feed member 25 has six bores 46 therethrough for receiving a baseball 47, shown in phantom lines in the drawings. A plate 48 is fixed to the main frame 21' below the feed member 25 and has only one bore 49 therethrough, so that as the feed member 25 rotates, it will collect baseballs in all six bores, but they will be held in the bores 46 as the member rotates by the plate beneath until a bore 46 aligns with this one bore 49 in the plate. Whereupon, the baseball 47 will drop through the bore 49 and will be guided by the springs 33 and 34 into the arcuate guideway 30, and the arcuate guideway 30 will guide the baseball between wheels 22,23, and 24 for projection and imparting of spin to the ball.

The coil springs 33 and 34, which act to guide the baseballs from the rotary feed member to the arcuate guideway or curved channel member 30, being flexible or resilient may flex, as the wheel support frame with the three wheels mounted thereon and with the arcuate guideway 30 mounted thereon, pivots about the axis 26 on the U arm 36 to one side or pivots with the U shaped arm 36 about the horizontal axis to elevate or lower the wheel support frame and wheels, and still be able to guide the baseballs from the rotary member 25 into the arcuate guideway.

Thus, the feed operation from the revolving feed member 25 along the coil springs to the arcuate guideway to the wheels remains operative whether the support frame is pivoted to either side or forward or rearward and the arcuate guideway moves with the wheels, as the lower ends of the springs 33 and 34 can flex and move with the arcuate guideway while the upper ends remain fixed to the main frame.

The ball throwing and spin imparting device 20 has a ball hopper 50 mounted to the top of the main frame 21'. The hopper 50 is illustrated with an open top 50'; athough a suitable removable cover may be provided.

Operation

The ball throwing and spin imparting device 20 will have a plurality of baseballs 47 loaded into the top of the hopper 50. The hopper has inclined sides 50", so that the balls will gravitate down onto the top of the rotary ball feed member 25 to fil up all of the six bores 46 in the rotary feed member 25 with baseballs. A suitable conventional rotary agitating arm may be fixed to the center of the feed member in spaced relation thereabove, so as to rotate with the feed member 35 and agitate the baseballs to assure that baseballs fall into all of the six bores of the feed member as it rotates.

The plate 48, fixed beneath the rotary feed member 25, having only one bore 49, which is in vertical alignment with the springs 33 and 34, will allow each of the baseballs in the six bores, one after another, to drop through the bore 49 when that baseball aligns over the bore 49 as the rotary feed member rotates, so as to feed baseballs, one at a time, down the spring guideways 33 and 34 into the arcuate guideway 30.

From there, the arcuate guideway 30 will guide the baseballs received from the bore 49 forward in between the three wheels 22, 23, and 24 along their inner edges, 22' 23' and 24' and along the common axis 26 between the wheels.

Two motors 27 and 28 will be powered to rotate wheels 22 and 23 counterclockwise while motor 29 will be powered to rotate wheel 24 clockwise, when viewed from FIG. 2, so that when the baseball reaches the space between them along axis 26, the inner edges 22',23', and 24' of all three wheels will simultaneously engage the ball at three evenly spaced degree intervals about the circumference of the ball in a common plane perpendicular to axis 26 and will propell and drive the ball forward, left to right when viewed from FIG. 2, initially at least along the common axis 26.

Each of the three wheels will engage the baseball about its circumference at 120 degree intervals in a plane perpendicular to the forward movement of the ball along axis 26, by the concave annular outer surfaces 22', 23', and 24' frictionally engaging the baseball 47. The spacing between the concave outer surfaces 22', 23', and 24' will be only slghtly less than the distance along a chorde across the baseball at the 120 degree intervals, so as to assure a positive, frictional, simultaneous engagement occurs of the concave outer surfaces 22', 23', and 24' of all three wheels with the baseball as the baseball is engaged in between the wheels and propelled forward by their engagement.

Each of the three wheels will have a resilient annular outer ring extending about a center plastic wheel portion, and the resilient annular ring portion will have the resilient annular concave outer surfaces 22', 23', and 24', which engage the baseball 47 directly. The resilient annular ring will have sufficient radial thickness to compress sufficient to receive and propell the baseball therebetween.

The Application of Selective Spin to the Ball

The application of selective spin to the ball by the wheels while the wheels propel the ball forward, from left to right when viewed from FIG. 2, operates as follows:

If it is desired to apply forward spin to the ball, at the top or zero degree interval about a circle, as viewed from FIG. 1, then the forward spin at that degree interval would cause the ball to spin clockwise as the ball also moves forward, left to right, as viewed from FIG. 2. Also, when forward spin is applied to the top it might be referred to as overspin, and the spin at the bottom off the ball could be referred to as reverse spin.

Further, if it is desired to apply forward spin or overspin at the top or at a zero degree interval about the 360 degree circle, wheels 22 and 23 will be powered at the same speed to each other and at a faster speed than wheel 24, thereby applying forward spin or overspin to the top of the baseball at it passes from left to right between the wheels. Forward spin can be applied at each of the three 120 degree intervals about the circle where the wheels are located in this manner, and the amount of forward spin or overspin can be varied, by increasing or decreasing the ratio of speed differential between the faster and slower wheels.

If it is desired to apply forward spin primarily at an interval between zero and 60° clockwise from the top, with the amount of forward or overspin remaining substantially the same; the speed of wheel 23 will remain substantially the same while the speed of wheel 22 will be reduced toward the speed of wheel 24, depending upon the interval chosen between zero and chosen, between zero and 60 degrees. Also, the speed of motor 24 will remain the same. When the forward spin interval chosen for maximum forward spin is 60 degrees clockwise, then the speed of wheel 23 will remain the same as before, wheel speed 24 will remain the same, and the speed of wheel 22 will have been reduced to the speed of wheel 24.

Continuing to apply forward spin to the ball at a degree interval between 60 degrees and 120 degrees, clockwise, with the amount of forward spin remaining substantially the same; the speed of wheels 22 and 23 will remain the same, while the speed of wheel 24 will be gradually increased to the speed of wheel 23, until when the maximum forward spin degree interval chosen is 120 degrees clockwise from the top, the speed of wheel 24 will have been increased to have reached the speed of wheel 23.

This process will repeat itself for every 120 degree interval, as the interval chosen for forward spin, when propelling a ball forward, is moved about the entire 360 degrees, thereby repeating itself three times in 360 degrees.

Thus it is understood that a novel ball throwing and spin imparting device and method has been provided, which can propell a ball at various selected speeds forward and apply a forward spin to the ball at any selected degree interval or point of circumference on the ball about 360 degrees about the axis of travel of a ball and in a plane perpendicular to the travel of the ball forward along the axis, without the need of pivoting the wheels to different degrees about the axis of travel to obtain the forward spin at different degrees.

It will further be seen that the novel structure and method bas been provided for imparting a forward spin to the ball at any selective degree interval about the circle that includes a plurality of rotary wheel drive members positioned at even degree intervals about the ball of less than 180 degrees apart from one another in a common plane laterally or tranversely of the path of the projection of the ball.

It is contemplated that various different intervals and ratios of speed may be programmed to provide various different spins and varying amount of forward spin, over and under, to the ball, so as to simulate various pitches of the ball, when the device is being used, for example, to propell a baseball to a practicing batter. It is understood that while the invention is being described for propelling and imparting a spin to a ball, such as baseball, the device may also be adapted for use to provide propellant speed and spin to various other types of balls, such as tennis, volley, and ping pong balls.

Further, it will be seen that the steps of the novel method include rotating all of the rotary drive members or wheel simultaneusly along planes extending radially inward to a common axis, and wherein said rotary members have their innermost edges engaging the ball and rotating forward momentarily parallel to one another and to a common axis, with their innermost edges engaging the ball at degree intervals where the rotary members are positioned less than 180 degrees laterally apart from one another; selecting degree intervals, greater or less than 180 degrees, for applying forward longitudinal spin to the ball while engaging and projecting the ball forward with the rotary wheel members; regulating the speed of rotation of all the drive wheel members so that those of the drive wheel members located at degree intervals laterally apart from one another that are more closely adjacent the selected degree interval for applying the forward longitudinal spin have a greater rotational speed, than those of the drive wheel members laterally apart from one another that are further away from the selected degree interval laterally about the circle, to thereby apply forward longitudinal spin to the ball at the selected degree interval.

It will be obvious that various changes and departures may be made to the invention without departing from the spirit and scope thereof, and accordingly, it is not intended that the invention be limited to that specifically described in the specification or as illustrated in the drawings, but only as set forth in the appended claims werein:

What is claimed is:

1. A ball throwing apparatus comprising: a main frame, a wheel support frame pivotally mounted to said main frame to pivot about a vertical and horizontal axis on said main frame; said wheel support frame having three ball throwing and spin imparting wheels rotatably mounted to said support frame about a common axis and in a common plane perpendicular to said common axis at 120 degree intervals about said common axis; a motor mounted to said support frame adjacent each of said wheels for individually powering the rotation of each of said wheels; said wheels each having concave, outer annular resilient surfaces for engagement with a ball simultaneously when the ball is positioned along a common axis between the wheels;

a ball storage bin means mounted above said wheel support frame on said main frame; said bin means having an opening along its bottom, a rotary feed means having a plurality of openings of a size larger than that of the ball and adapted to rotate its openings beneath the bin means opening to receive balls therefrom, a resilient downward channel means mounted beneath said rotary means at a location spaced away from said bin means opening, said resilient downward channel means having a gradually curved channel means at the bottom thereof with an opening at one end communicating with the bottom of the resilient channel means and an opening at the other end communicating with the wheels at the common axis between the wheels;

whereby the rotary feed means may be rotated to receive balls from the bin means opening and carry the balls to the resilient downward channel means and empty the balls in the resilient downward channel means, where the balls can gravitate down the resilient channel means into the curved channel means and in between the rotating wheels where the wheels can engage and propel the balls outward from the wheels on the opposite side from the resilient and curved channel means;

said wheels being rotatably mounted on said support frame, relative to one another, to rotate only about axes perpendicular to the common axis and in planes parallel to one another with said motors being capable of being varied in speed individually to apply a spin to the ball being propelled at different locations about a circle perpendicular to the common axis between the wheels by varying the speeds of their respective motors, said support frame and said wheels and motors thereon being pivotable about their said vertical and horizontal axes relative to the main frame and said bin and rotary means, with said resilient downward channel means being resilient between said rotary means and curved channel means to accommodate said movement; said resilient channel means comprising a pair of springs.

2. A ball throwing apparatus comprising: a main frame, a wheel support frame pivotally mounted to said main frame to pivot about a vertical and horizontal axis on said main frame;

three concave shaped outer surface wheels each rotatably mounted to said support frame to rotate on said support frame at fixed 120 degree intervals about a center axis with their axes fixed perpendicular to said center axis on said support frame, one of said three wheels being positioned vertically entirely below the center axis, the other two of said wheels extending upward and outward in opposing angles and positioned entirely above the center axis, each of said wheels having longitudinally, circumferential continuous, laterally concave shaped, resilient surfaces continuing about the entire longitudinal circumference of each wheel for engagement of their concave surfaces about a ball about the center axis between the wheels;

each of the three concave outer surface wheels having its concave lateral surfaces across its width an arc segment of slightly less than one third of a circle, with the radius of its concavity at portions of each concavity being slightly less than the radius of the ball to provide a relatively shallow concavity in its radius to the center axis with respect to the ball radius to the center axis, so as to provide each of the three concave wheels with sufficient width in its concavity that each wheel has its lateral outer resilient edge of its concave surface immediately adjacent the lateral resilient edge of the next concave surface of the next adjacent concave wheel, so as to provide a concave surface about at least substantially the entire lateral circular surface of the ball for surrounding lateral engagement with the ball;

a ball storage receptacle bin mounted on said main frame above said three wheels on said support frame;

said bin having an opening along its bottom, a rotary feed means having a plurality of openings of a size larger than that of the ball and adapted to rotate its openings beneath the bin opening to receive balls therefrom;

a drop feeding means comprising a downward resilient channel means having a gradually curved channel means at the bottom thereof with an opening at one end communicating with the resilient channel means and an opening at the other end communicating with the wheels at the common center axis between the wheels, said curved channel means having a base extending horizontally across, and upward sides on each opposing side of the base, with the base at its forwardmost end below the concavity at the top of the vertical wheel;

whereby the rotary feed means may be rotated to receive balls from the bin opening and carry the balls to the downward resilient channel means and empty the balls in the downward resilient channel means, where the balls can gravitate down the resilient channel means and curve gradually forward in the curved channel means and in between the three rotating wheels, where the wheels can engage and propel the balls outward from the wheels on the opposite side from the resilient and curved channel means;

said gradually curving channel means initially at its rearward end being spaced rearward, away from each of said concave wheels in excess of the diameter of the ball and remaining spaced away until the base of the curved channel means has curved gradually forward into a plane parallel to and below the center axis and is immediately adjacent the wheels, sufficiently to enable the ball to initially reach and engage each of the wheels substantially simultaneously along the center axis;

said wheels being rotatably mounted on said support frame, relative to one another, to rotate only about axes perpendicular to the common center axis and in planes parallel to one another with said motors being capable of being varied in speed individually to apply a spin to the ball being propelled at different locations about a circle perpendicular to the center axis between the wheels by varying the speeds of their respective motors, said support frame and said wheels and motors thereon being pivotable about their said vertical and horizontal axes relative to the main frame and said bin and rotary means, with said resilient downward channel means being resilient to accommodate said movement.

3. A ball throwing apparatus comprising: a main frame, a wheel support frame pivotally mounted to said main frame to pivot about a vertical and horizontal axis on said main frame;

three concave shaped outer surface wheels each rotatably mounted to said support frame to rotate on said support frame at fixed 120 degree intervals about a center axis with their axes fixed perpendicular to said center axis on said support frame, each of said wheels having longitudinally, circumferential continuous, laterally concave, resilient surfaces continuing about the entire longitudinal circumference of each wheel for engagement of their concave surfaces about a ball about the center axis between said wheels;

each of the three concave outer surface wheels having its concave lateral surfaces across its width an arc segment of slightly less than one third of a circle, with the radius of its concavity at portions of each concavity being slightly less than the radius of the ball to provide a relatively shallow concavity in its radius to the center axis with respect to the ball radius to the center axis, so as to provide each of the three concave wheels with sufficient width in its concavity that each wheel has its lateral outer resilient edge of its concave surface immediately adjacent the lateral resilient edge of the next concave surface of the next adjacent concave wheel, so as to provide a concave surface about at least substantially the entire lateral circular surface of the ball for surrounding lateral engagement with the ball;

a ball storage receptacle bin mounted on said main frame above said three wheels on said support frame;

said bin having an opening along its bottom, a power feed means to receive balls from beneath the bin opening;

a drop feeding means comprising a downward resilient channel means having a gradually curved channel means at the bottom thereof with an opening at one end communicating with the resilient channel means and an opening at the other end communicating with the wheels at the common center axis between the wheels, said gradually curving channel means curving gradually forward and along and immediately beneath said center axis and terminating immediately adjacent each of said wheels;

whereby the feed means may be operated to receive balls from the bin opening and carry the balls to the downward resilient channel means and empty the balls in the downward resilient channel means, where the balls can gravitate down the resilient channel means into the curved channel means and in between the rotating wheels, where the wheels can engage and propel the balls outward from the wheels on the opposite side from the resilient and curved channel means;

said gradually curving channel means initially at its rearward end being spaced rearward away from each of said wheels in excess of the diameter of the ball until immediately adjacent the wheels, sufficiently to enable the ball to initially reach and engage each of the wheels substantially simultaneously along the center axis;

said wheels being rotatably mounted on said support frame, relative to one another, to rotate only about axes perpendicular to the center axis and in planes parallel to one another with said motors being capable of being varied in speed individually to apply a spin to the ball being propelled at different locations about a circle perpendicular to the center axis between the wheels by varying the speeds of their respective motors, said support frame and said wheels and motors thereon being pivotable about their said vertical and horizontal axes relative to the main frame and said bin and rotary means, with said resilient downward channel means being resilient to accommodate said movement.

4. A ball throwing apparatus according to claim 3, wherein one of said three wheels is positioned vertically entirely below the center axis, and the other two of said wheels extend upward and outward in opposing angles and positioned entirely above the center axis.

* * * * *